US007576763B2

(12) United States Patent
Fitzpatrick et al.

(10) Patent No.: US 7,576,763 B2
(45) **Date of Patent: *Aug. 18, 2009**

(54) HYBRID IMAGER PRINTER USING REFLEX WRITING TO COLOR REGISTER AN IMAGE

(75) Inventors: Anne K. Fitzpatrick, Rochester, NY (US); Michael J. Martin, Hamlin, NY (US); James W. Stevens, Rochester, NY (US); Rosario A. Bracco, Webster, NY (US); Carlos O. Alva, Penfield, NY (US); John Alan Durbin, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 458 days.

This patent is subject to a terminal disclaimer.

(21) Appl. No.: 11/289,888

(22) Filed: Nov. 30, 2005

(65) Prior Publication Data

US 2007/0120938 A1 May 31, 2007

(51) Int. Cl.
*B41J 2/47* (2006.01)
*B41J 2/385* (2006.01)

(52) U.S. Cl. ..... 347/234; 347/116

(58) Field of Classification Search ..... 347/116, 347/234; 318/685; 399/164, 395, 167, 400; 250/226

See application file for complete search history.

(56) References Cited

U.S. PATENT DOCUMENTS 5,113,202 A 5/1992 Loce et al.
5,208,636 A 5/1993 Rees et al.
5,281,999 A 1/1994 Edmunds
5,394,223 A 2/1995 Hart et al.
5,412,302 A * 5/1995 Kido et al. ..... 318/685
5,950,051 A * 9/1999 Casella ..... 399/164
6,141,526 A * 10/2000 Ikeda ..... 399/395
6,218,660 B1 * 4/2001 Hada ..... 250/226
6,307,578 B1 * 10/2001 Castelli ..... 347/116
7,126,621 B2 * 10/2006 Castelli et al. ..... 347/234
7,224,932 B2 * 5/2007 Omata ..... 399/400
2004/0208672 A1 * 10/2004 Igarashi ..... 399/167

OTHER PUBLICATIONS

U.S. Appl. No. 10/909,075, filed Jul. 30, 2004, titled "Printer Using Hybrid Reflex Writing Image".

* cited by examiner

*Primary Examiner*—Stephen D Meier
*Assistant Examiner*—Carlos A Martinez, Jr.

(57) ABSTRACT

Reflex writing is a group of algorithms developed to maintain color registration in xerographic systems using multiple imagers, in which sequential color separations are written based on events in the spatial domain. The imaging system includes a raster output scanner imager for the black station and a light emitting diode bar for the color station. A simulated machine clock signal is generated based on a running average of a plurality of actual machine clock periods determined from pulses received from a photoreceptor module drive roll encoder. For each black scanline written the distance the belt travels is tracked using the simulated machine clock signal, and when the black latent image scanline has traveled the known distance between the two imagers, the light emitting diode scanline is written registered with respect to the raster output scanner scanline.

16 Claims, 3 Drawing Sheets

HYBRID IMAGER PRINTER USING REFLEX WRITING TO COLOR REGISTER AN IMAGE

BACKGROUND AND SUMMARY

This invention relates generally to imaging devices and more particularly to imaging devices with a plurality of imagers that provide sequential images that are overlaid to form a composite image.

Imaging devices often utilize a first color to produce an image, portions of which are desired to be highlighted using a second color. In order to produce the desired results the imaging device must precisely register the highlight color image with the first image. Highlight color image registration is often challenging. It is often the case that a highlight printer is designed as a retrofit of a monochromatic engine in which the quality of the motion of the photoreceptor is only good enough to limit the banding to a tolerable level. The monochromatic image is typically laid down at a constant rate of lines per unit time. If the second imager is also caused to write at a constant rate, serious errors in color to color registration may occur.

In single pass electrophotographic printers having more than one process station which provide sequential images to form a composite image, critical control of the registration of each of the sequenced images is required. This is also true in multiple pass color printers, which produce sequential developed images superimposed onto a photoreceptor belt for charging with toner to form a multi-color image. Failure to achieve registration of the images yields printed copies in which the color separations forming the images are misaligned. This condition is generally obvious upon viewing of the copy; as such copies usually exhibit fuzzy color separation between color patches, bleeding and/or other errors, which make such copies unsuitable for intended uses.

A typical highlight color reproduction machine records successive electrostatic latent images on the photoconductive surface. One latent image is usually developed with black toner. The other latent image is developed with color highlighting toner, e.g. red toner. These developed toner powder images are transferred to a sheet to form a color-highlighted document. When combined, these developed images form an image corresponding to the entire original document being printed. Such color highlighting reproduction machine can be of the so-called single-pass variety, where the color separations are generated sequentially by separate imaging and toning stations, or of the so-called multiple-pass variety, where the separations are generated by a single imaging station in subsequent passes of the photoreceptor and are alternatively toned by appropriate toning stations. A particular variety of single-pass highlight color reproduction machines using tri-level printing have also been developed. Tri-level electro-statographic printing is described in greater detail in U.S. Pat. No. 4,078,929. As described in this patent, the latent image is developed with toner particles of first and second colors simultaneously. The toner particles of one of the colors are positively charged and the toner particles of the other color are negatively charged.

Another type of color reproduction machine which may produce highlight color copies initially charges the photoconductive member. Thereafter, the charged portion of the photoconductive member is discharged to form an electrostatic latent image thereon. The latent image is subsequently developed with black toner particles. The photoconductive member is then recharged and image wise exposed to record the highlight color portions of the latent image thereon. A highlight latent image is then developed with toner particles of a color other than black, e.g. red, and then developed to form the highlight latent image. Thereafter, both toner powder images are transferred to a sheet and subsequently fused thereto to form a highlight color document.

The operation of highlight and color printers is well known and is described in greater detail in U.S. Pat. Nos. 5,113,202; 5,208,636; 5,281,999; and 5,394,223, the disclosures of which are hereby incorporated herein by this reference.

A hybrid reflex writing printer is described in commonly-owned U.S. patent application Ser. No. 10/909,075, which is incorporated by reference herein.

A simple, relatively inexpensive, and accurate approach to register latent images superimposed in such printing systems has been a goal in the design, manufacture and use of electrophotographic printers. This need has been particularly recognized in the color and highlight color portion of electrophotography. The need to provide accurate and inexpensive registration has become more acute, as the demand for high quality, relatively inexpensive color images has increased.

The disclosed imaging device utilizes a second imager for forming the highlight latent image at a time following the forming of the first latent image that accounts for irregularities in the movement of the photoreceptor belt between the first imager and the second imager. If the second imager is an LED bar as disclosed herein, one can take advantage of its ability to fire a line of data whenever it is most appropriate for color registration.

According to one aspect of the disclosure, an imaging device and method are provided for producing multicolor images from image data containing data representing an image of a first color and an image of a second color to be registered relative to the image of the first color onto a substrate by transferring colorants of the first and second colors to the substrate. The imaging device includes a first imager configured to generate an output corresponding to the image of the first color at a first exposure station. A second imager is configured to generate an output corresponding to the image of the second color at a second exposure station. A photoreceptor belt is configured to pass the first imager and the second imager. A photoreceptor drive system is coupled to the photoreceptor belt to drive the photoreceptor belt in a process path past the first and second imagers in a process direction. An encoder generating encoder pulses is coupled to the photoreceptor drive system. The second imager is displaced along the process path from the first imager by a displacement corresponding to a nominal number of the encoder pulses. A controller is coupled to receive the encoder pulses. The controller determines an actual machine clock period based on a time between successive encoder pulses. The controller generates a simulated machine clock signal based on a running average of a plurality of the actual machine clock periods. The controller uses the simulated machine clock signal to count up to the nominal number following firing of the first imager for a given scanline of the image data to determine a target time for firing the second imager for the given scanline.

Additional features and advantages of the present invention will become apparent to those skilled in the art upon consideration of the following detailed description of preferred embodiments exemplifying the best mode of carrying out the invention as presently perceived.

BRIEF DESCRIPTION OF THE DRAWINGS

A more complete understanding of the disclosed apparatus can be obtained by reference to the accompanying drawings wherein.

These figures merely illustrate the disclosed methods and apparatus and are not intended to exactly indicate relative size and dimensions of the device or components thereof.

DETAILED DESCRIPTION

The method and system herein disclosed compensate for the color-to-color registration errors caused by irregularities in the photoreceptor belt motion, for example due to variations in the drive system. The proposed method employed by the machine controller utilizes a rotary encoder 16 mounted on the drive roller 18 in a manner to be explained below.

The method and device are described for a two-color highlight printer 10 having a belt photoreceptor system. Those skilled in the art will recognize that the teachings of the disclosure could be applied to a printer having more than two colors or other imaging device such as a photocopy machine or multifunctional printer/copier within the scope of the disclosure.

Figure 1:
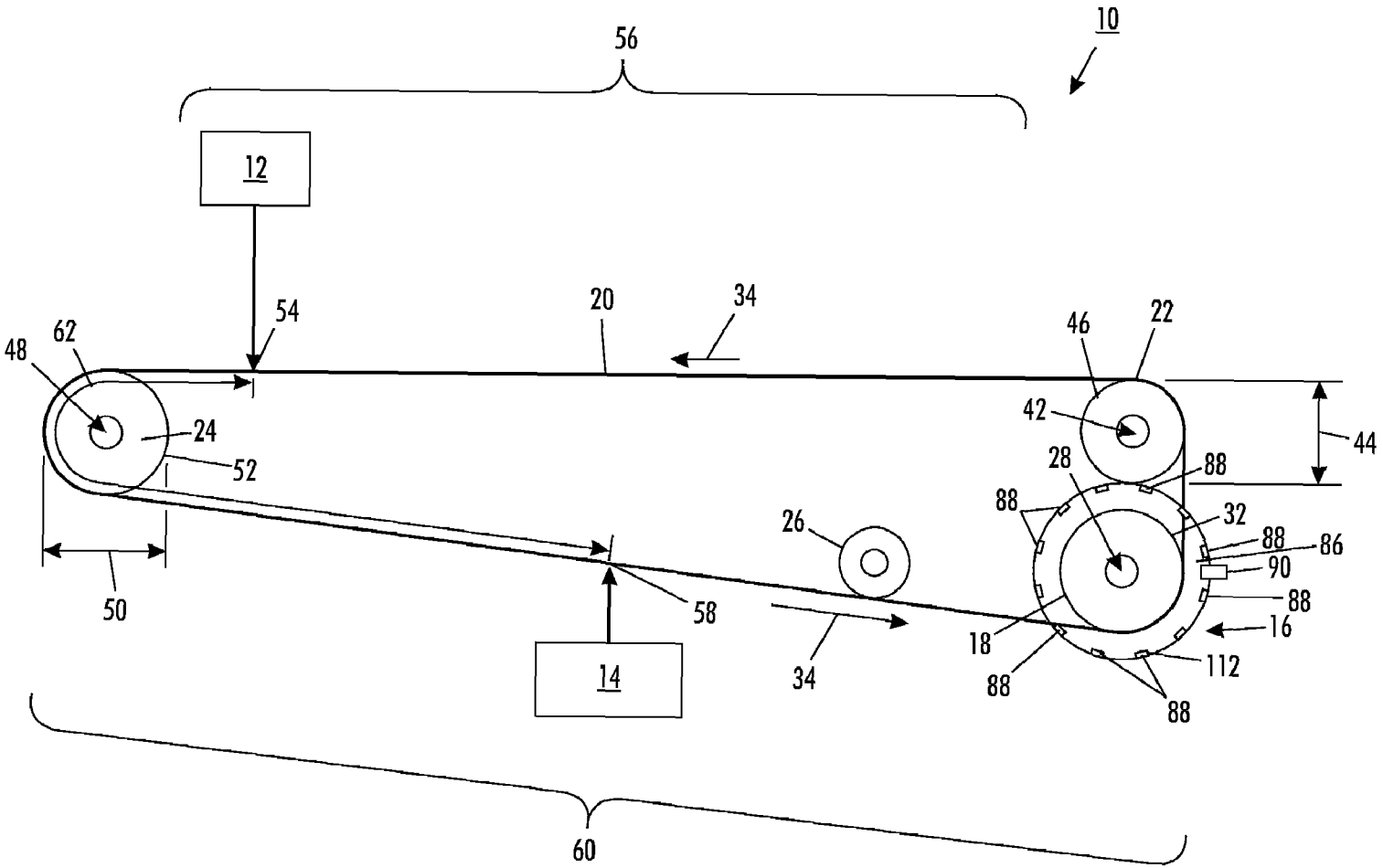
FIG. 1 is a schematic side view of an imaging device with components removed for clarity showing a drive roller including a rotary encoder associated therewith, a stripper roller, a tensioning roller and a guide roller, a photoreceptor belt entrained on the drive roller, stripper roller, tensioning roller and guide roller for movement along a processing path, a first imager and a second imager.

A simplified diagram of a two-color highlight imaging device 10 is shown, for example, in FIG. 1. Belt charging stations, toner application stations, image transfer stations, substrate transport stations, substrate developer stations and belt cleaning stations are not illustrated in FIG. 1. Such devices and their arrangement are well known. Examples of more completely described highlight imaging devices are disclosed in the incorporated U.S. Pat. Nos. 5,113,202; 5,208,636; 5,281,999 and 5,394,223.

The imaging device 10 includes a photoreceptor belt 20 that is mounted for rotation about a plurality of rollers 18, 22, 24, 26 mounted to a frame of the imaging device 10. In the illustrated embodiment, the plurality of rollers includes a stripper roller 22, the drive roller 18, a tensioning roller 24 and a guide roller 26. The rollers 18, 22, 24 and 26 define a process path along which the photoreceptor belt 20 progresses during image production. It is within the scope of the disclosure for fewer or more rollers to be utilized to define the process path guiding the photoreceptor belt 20 as it moves in a process direction (indicated by arrow 34).

Figure 3:
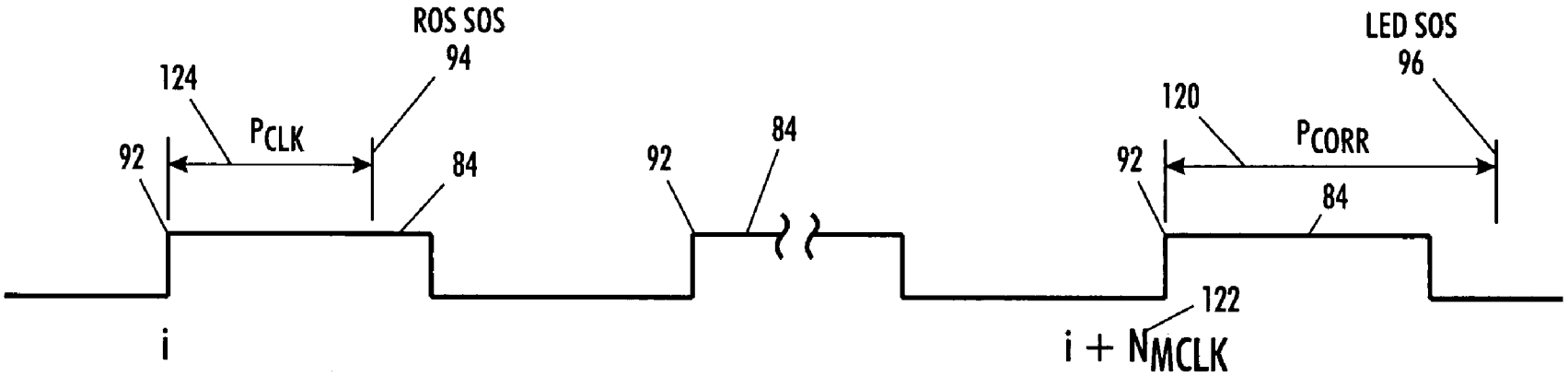
FIG. 3 is a timing diagram indicating the relation between the start of the scans of the first and second imagers for a given scanline wherein pulses generated by the rotary encoder coupled to the drive roller are utilized to determine a target time for initiating the second imager.

In the illustrated embodiment, drive roller 18 is a generally cylindrical roller having a longitudinal axis 28, a nominal diameter 30, shown in FIG. 3, and a drive surface 32 having a nominal circumference formed generally concentrically about the symmetry axis 28. The drive roller 18 is mounted to the frame of the imaging device 10 to rotate when driven about its axis 28. The symmetry axis 28 is mounted generally perpendicular to the process direction 34. A rotary encoder 16 is associated with the drive roller 18 to sense the angular position (and consequently the angular velocity) of the drive roller 18. Thus, rotary encoder 16 acts as an angular position sensor for sensing the angular position of the drive roller relative to a reference. Illustratively the rotary encoder 16 is configured to generate a number of pulses during each revolution of the drive roller 18. The number of pulses generated by the rotary encoder 16 during each revolution of the drive roller 18 is an integer value. In the illustrated embodiment, the rotary encoder 16 is mounted to the shaft of the drive roller 18. The rotary encoder 16 may be implemented using a 1024 pulse per revolution rotary encoder. The signal generated by the rotary encoder 16 is received by the controller 40 of the imaging device 10.

In the illustrated embodiment, the stripper roller 22 is a generally cylindrical roller having a symmetry axis 42, a nominal diameter 44 and a belt engaging surface 46 formed generally concentrically about the axis 42. The stripper roller 22 is mounted to the frame of the imaging device 10 to rotate about its symmetry axis 42. The axis 42 is mounted generally perpendicular to the process direction 34. In the illustrated embodiment, the stripper roller 22 is mounted downstream of the driver roller 18 along the process path in the process direction 34. In the illustrated embodiment, the nominal diameter 44 of the stripper roller 22 is smaller than the nominal diameter 30 of the drive roller 18.

In the illustrated embodiment, the tensioning roller 24 is a generally cylindrical roller having a symmetry axis 48, a nominal diameter 50 and a belt-engaging surface 52 formed generally concentrically about the axis 48. The tensioning roller 24 is mounted to the frame of the imaging device 10 to rotate about its symmetry axis 48. The tensioning roller 24 is mounted for linear movement relative to the frame of the imaging device 10 perpendicularly to its axis 48, the movement such as to maintain said axis 48 on a plane nearly parallel to the belt surface in the span between rollers 22 and 24. A force is applied so as to provide tension to the photoreceptor belt 20. The symmetry axis 48 is mounted generally perpendicular to the process direction (indicated by arrow 34). In the illustrated embodiment, the nominal diameter 50 of the tensioning roller 24 is smaller than the nominal diameter 30 of the drive roller 18.

In the simplified embodiment illustrated in FIG. 1, a single guide or idler roller 26 is mounted to the frame of the imaging device 10 to aid in defining the process path along which the photoreceptor belt 20 travels. Those skilled in the art will recognize that a typical imaging device 10 will include a plurality of such guide or idler rollers 26 mounted to the frame of the imaging device 10 acting to support the photoreceptor belt 20 and to define the process path along which it travels. Additional structures, such as backer bars or rollers, blades and other components may aid in supporting the photoreceptor belt 20 and defining the process path along which it progresses, within the scope of the disclosure.

The first imager 12 is located between the tensioning roller 24 and the stripper roller 22 for producing a latent image on the photoreceptor belt 20 as it passes by the first imager 12. The first imager 12 is mounted adjacent the photoreceptor belt 20 to scan an image at a first exposure station 54 onto the photoreceptor belt 20. Illustratively, the first exposure station 54 is positioned along the process path between the stripper roller 22 and the tensioning roller 24 in what will be referred to herein as the first imager span 56 of the process path. In the illustrated embodiment, the first imager 12 is taken to be a laser Raster Output Scanner ("ROS") of the type commonly used in monochromatic imaging devices.

The second imager 14 is located between the tensioning roller 24 and the guide roller 26 to produce a second image on the photoreceptor belt 20 as it passes by the second imaging device. The second imager 14 is mounted adjacent to the photoreceptor belt 20 to scan an image at a second exposure station 58 onto the photoreceptor belt 20. Illustratively, the second exposure station 58 is positioned along the process path between the tensioning roller 24 and the drive roller 18 in what will be referred to herein as the second imager span 60 of the process path. The second exposure station 58 is displaced in the process direction along the process path by a displacement 62 from the first exposure station 54. In the illustrated embodiment, the second imager 14 is a Light Emitting Diode ("LED") bar that can scan an image line on demand.

Figure 2:
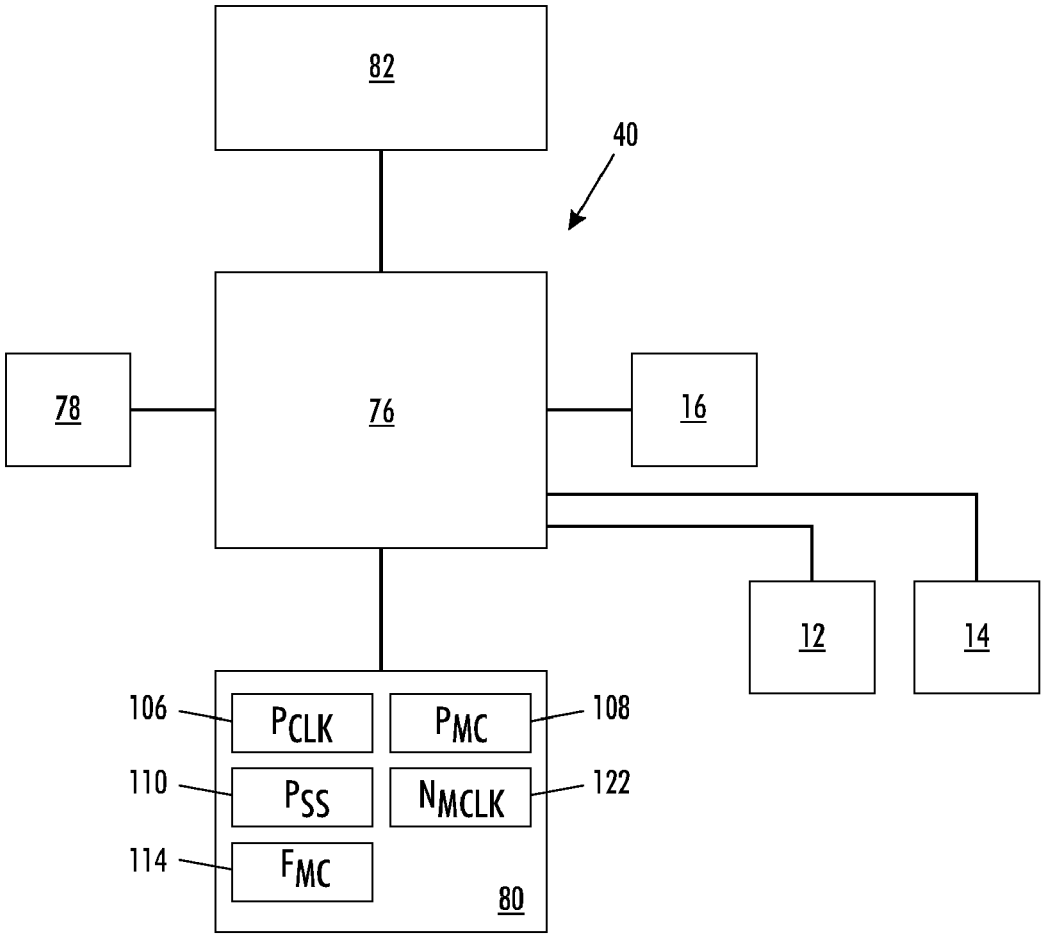
FIG. 2 is a schematic diagram of the imagers and controllers of the imaging device of FIG. 1.

As shown for example, in FIG. 2, the controller 40 includes a microprocessor 76, a clock 78 and memory 80. The microprocessor 76 processes image data received from an image data source 82 and drives the first imager 12 and second imager 14 to expose images on the photoreceptor belt 20 that can be developed to generate a print of an image corresponding to the image data received from the image data source 82. The image data source 82 may be the output of a raster input scanner, a computer file or the output of other image data generating devices within the scope of the disclosure. The image data represents an image that may include text or graphics some of which is to be printed in a first color and some of which is to be printed or highlighted in a second color. The clock 78 is a 25 MHz clock, which is used as the standard time measurement device.

As mentioned above, a laser ROS of the type used as the first imager 12 writes subsequent lines at the first exposure station 54 using a laser beam, which is scanned by virtue of the spinning of a multifaceted polygon mirror. The rate at which the lines are scanned (i.e. formed upon the photoreceptor belt 20) is essentially constant in time. If the second imager 14 were to lay down image lines at a constant rate in time, and if the drive roller 18 rotated at an irregular rate, or if the length of the photoreceptor belt 20 varied during rotation as the result of mechanical or thermal expansion or contraction, the images would be distorted and the time delay between the passages of the same point of the photoreceptor under the first and the second imagers would vary in time. Usually the amount of distortion is small enough that it does not damage a monochromatic print, unless its magnitude and frequency are such as to create the so-called phenomenon of "banding", a periodic variation of image density at a spatial frequency in the neighborhood of one cycle per millimeter at normal viewing distance.

When, as in the disclosed apparatus, a second imager 14 is utilized to form a second image on the photoreceptor belt 20, the irregularity of the motion of the photoreceptor belt 20 can cause the time delay between a selected area of photoreceptor belt 20 passing the first exposure station 54 and the second exposure station 58 to vary. The variation in the delay between a selected area of photoreceptor belt 20 passing the first exposure station 54 and second exposure station 58 results in improper registration of the second image with respect to the first image. As an example, in a highlight printer wherein the first imager creates text in a first color, which is to be interspersed or highlighted by text or logos in a second color, the improper registration of the second image with respect to the first image can result in misalignment of the highlight text or logos with the text of the first color, failure to highlight the desired text or even highlighting of inappropriate text. In a color printer generating full, typically four, color images using a plurality of imagers, improper registration of the various color images is an even larger problem.

The present invention determines a target time for initiating imaging by the second imager for a given scanline relative to when the first imager was initiated for that same scanline in a manner that compensates for geometrical and/or motion errors in the photoreceptor drive system. In the disclosed device 10, the rotary encoder 16 mounted on the shaft of the drive roller 18 generates encoder pulses 84 that are sent to the microprocessor 76 of the controller 40. The controller 40 determines an actual machine clock period by determining the time between successive encoder pulse rising edges 92. For example, the controller 40 may generate an actual machine clock signal comprising actual machine clock pulses that directly correspond to the encoder pulses 84, and use that actual machine clock signal to determine the actual machine clock period by measuring the time between successive actual machine clock pulses by reference to a standard clock signal such as a 25 MHz clock. For each scanline or each set of scanlines, the controller 40 determines when to initiate imaging by the second imager relative to initiation of imaging by the first imager using a simulated machine clock signal that is based on a running average of the actual machine clock periods, which will be explained in more detail below. The second imager 14 is spaced from the first imager 12 along the direction of movement of the photoreceptor belt a displacement 62 corresponding to a nominal number ($N_{MCLK}$ 122) of encoder pulses 84 plus an adjustment time ($P_{CORR}$ 120), explained in further detail below. A pulse 84 is generated by the rotary encoder 16 attached to the shaft of the rotating drive roller 18 each time the drive roller 18 has rotated through a specific angular displacement. Typically encoders producing 512 or 1024 pulses per revolution are used. Therefore, for a 50 mm diameter drive roll, a 1024 pulse per revolution encoder produces subsequent pulses at a spacing on the belt of approximately 0.153 millimeters, or 153 microns. It is understood that encoder pulses represent rotation angle and, therefore space on the belt surface. This space is not rigorously, but approximately, equal to time multiplied by the nominal angular velocity. For small corrections, such as it is the case in the applications of highlight color printers, the difference between the two is negligible.

An imaging system of the type disclosed generally attempts to drive the drive roller 18 at a nominal angular velocity. The displacement 62 between the first exposure station 54 of the first imager 12 and the second exposure station 58 of the second imager 14 along the path of rotation of the photoreceptor belt 20 is approximately known by design and can be evaluated at a particular time by calibration based on two reference lines laid by the ROS and the LED bar. Thus, the displacement 62 between the first imager 12 and the second imager 14 corresponds to a given number of encoder pulses 84. While it would be advantageous if the displacement 62 corresponded exactly to an integer number of encoder pulses 84, in practice it is difficult to precisely position the two imagers in such a manner due to manufacturing tolerances. Thus, the displacement 62 is determined to correspond to a nominal integer number ($N_{MCLK}$ 122) of encoder pulses 84 plus an adjustment time ($P_{CORR}$ 120). The nominal count ($N_{MCLK}$ 122) and the adjustment time ($P_{CORR}$ 120) are stored in memory 80.

The adjustment time ($P_{CORR}$ 120) comprises the sum of a time since the last machine clock ($P_{CLK}$ 106), a machine clock time delta ($P_{MC}$ 108), and a service setup time delta ($P_{SS}$ 110). The time since the last machine clock ($P_{CLK}$ 106) for a given scanline is equal to the time between the last encoder pulse and the writing of the ROS scan line at location 54 measured from the rising edge 92 of the encoder pulse until the start of the scan 94 by the ROS 12. Note that this value cannot be set to be equal to zero because it is not practical to so control the phase of the start of each ROS scan.

The fractional machine clock ($F_{MC}$ 114) is the fractional number of machine clocks beyond the nominal count ($N_{MCLK}$ 122) that should nominally be between the first imager and the second imager. If the displacement 62 were to correspond exactly to an integer number of machine clocks, then the fractional machine clock ($F_{MC}$ 114) would be zero. Thus, the fractional machines clock ($F_{MC}$ 114) accounts for the displacement 62 between the first and second imagers not corresponding exactly to an integer number of machine clocks. The fractional machine clock ($F_{MC}$ 114) is converted to a machine clock time delta ($P_{MC}$ 108) using the average of a plurality of actual machine clock periods. For example, the average of the eight most recent actual machine clock periods is calculated by the controller 40, and that average period is multiplied by the fractional machine clock ($F_{MC}$ 114) to determine the machine clock time delta ($P_{MC}$ 108) used in the adjustment time ($P_{CORR}$ 120). The number of machine clock periods used to calculate the average can be selected analytically and/or experimentally.

The service setup time delta ($P_{SS}$ 110) is a time constant that can be used as a service setup or adjustment in order to tweak the machine's timing to compensate for variations. The service setup time delta ($P_{SS}$ 110) may be positive or negative and is stored in a non-volatile memory such that it can be adjusted by a service technician or operator when the machine is in the field. This service setup time delta ($P_{SS}$ 110) can be evaluated by the operator by means of a test print upon which appropriate marks are printed by each of the first and second imagers 12, 14, respectively, activating lines on the photoreceptor belt 20, the appropriate toner being applied to each of these activated lines and transferring the toner to a medium such as paper. The operator may use optical magnification such as a loupe to view the marks and determine the appropriate correction.

The nominal count ($N_{MCLK}$ 122) plus adjustment time ($P_{CORR}$ 120) will not always exactly correspond to the distance that a specific location on the photoreceptor belt 20 travels. Irregularities in the motion of the photoreceptor belt 20 can result from various causes, such as irregularities in the drive system. The disclosed imaging device 10 compensates for the irregularities in the motion of the photoreceptor belt 20 by using a simulated machine clock signal that is based on a running average of a plurality of actual machine clock periods. Specifically, instead of simply counting each of the encoder pulses (from which the controller generates the actual machine clock signal with actual machine clock pulses directly corresponding to the encoder pulses) to count up to the nominal count ($N_{MCLK}$ 122), the controller 40 calculates a running average of a plurality of machine clock periods (e.g., 8 periods) of the actual machine clock signal, and uses that running average to produce a simulated machine clock signal which in turn is used to count up to the nominal count ($N_{MCLK}$ 122) in order to determine when to fire the second imager 14. The use of the running average of the machine clock periods to produce the simulated machine clock signal effectively filters out large deviations in the actual machine clock period.

The controller produces an actual machine clock signal based on the encoder pulses 84. The actual machine clock period is the time between two successive rising edge signals 92 produced by the encoder, which time is determined by the controller by reference to the clock 78. The number of machine clock periods used to calculate the running average for the simulated machine clock signal can be selected analytically and/or experimentally, for example based on inspection of various test prints made using various different numbers of machine clock periods to calculate the running average. For example, in the disclosed embodiments it was determined that it was advantageous to use a running average of eight machine clock periods to achieve the best registration. In that case, the simulated machine clock signal would be calculated by the controller on an ongoing basis by averaging the previous eight actual machine clock periods for each encoder pulse signal received from the encoder. In other words, the controller 40 determines the actual machine clock period for each set of successive encoder pulses (i.e., rising edge signals of the encoder), and maintains in memory the eight most recent actual machine clock periods, which are averaged on a running basis. This running average of machine clock periods is the simulated machine clock signal used for counting up to the nominal count ($N_{MCLK}$ 122) to determine when to fire the second imager 14.

The timing of initiation of scanning by the first imager 12 on the photoreceptor is determined by a linesync signal from the first imager (e.g. the ROS). For a given scanline, from the point in time of the linesync signal for the first imager (at which time the first imager is "fired"), the simulated machine clock signal is used to count up to the nominal count ($N_{MCLK}$ 122), then the adjustment time ($P_{CORR}$ 120) is added following the final nominal count, and then the second imager is initiated (i.e., "fired") at the end of the adjustment time ($P_{CORR}$ 120). Thus, counting up to the nominal count ($N_{MCLK}$ 122) using the simulated machine clock signal and adding the adjustment time ($P_{CORR}$ 120) defines the "target time" for initiating/firing the second imager following initiating/firing the first imager, for a given scanline.

The target time for initiating the second imager (nominal count ($N_{MCLK}$ 122)+adjustment time ($P_{CORR}$ 120)) may be determined for each scanline, resources (i.e., controller computing capacity and memory) permitting. Alternatively, the target time for initiating the second imager may be determined for the first scanline of a block of successive scanlines (e.g., 2, 4 or 8 scanlines), with the subsequent scanlines in the block being initiated in a timed manner after initiation of the first scanline, for example by using a programmable timer using the linesync signal. For example, if a block of four scanlines is used, the target time for initiating the second imager would be determined for only the first scanline in every block of four scanlines, and the second through fourth scanlines in each block would be initiated in a timed manner based on the linesync signal following initiation of the first scanline.

In order to avoid undesirable visually perceptible banding artifacts, the time period between firing the first and second imagers can be compared for subsequent blocks of scanlines, and the difference in that time period (i.e., correction time) can be spread out over the plurality of scanlines in the block. If the amplitude of the correction time is significant (i.e., if the time period between firing the first and second imagers determined by the controller for a given block of scanlines is significantly different from that time period for the previous block of scanlines), applying the entire correction time at the first scanline in the given block could shift the color scanline placement enough to create a visibly objectionable banding defect in the image. In other words, the amplitude of the reflex write correction is modulated to spread the correction out over the number of scanlines in the scanline block, such that registration performance is maintained, while minimizing the potential for visual banding in the prints. There are numerous approaches to spreading the correction out over a plurality of scanlines, such as dividing the correction equally across each a scanline in the interval or by applying a step correction at specific intervals within the scanline block.

Although the invention has been described with reference to specific preferred embodiments, it is not intended to be limited thereto, rather those having ordinary skill in the art will recognize that variations and modifications may be made therein which are within the spirit of the invention and within the scope of the claims.

It will be appreciated that various of the above-disclosed and other features and functions or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. An imaging device for producing multicolor images from image data containing data representing an image of a first color and an image of a second color to be registered relative to the image of the first color onto a substrate by transferring colorants of the first and second colors to the substrate, the imaging device comprising:

a first imager configured to generate an output corresponding to the image of the first color at a first exposure station, a second imager configured to generate an output corresponding to the image of the second color at a second exposure station;

a photoreceptor belt configured to pass the first imager and the second imager;

a photoreceptor drive system coupled to said photoreceptor belt, said photoreceptor drive system driving said photoreceptor belt in a process path past the first and second imagers in a process direction;

an encoder coupled to said photoreceptor drive system, the encoder generating encoder pulses;

said second imager being displaced along said process path from said first imager by a displacement corresponding to a nominal number of said encoder pulses, a controller coupled to receive the encoder pulses, the controller determining an actual machine clock period based on a time between successive ones of said encoder pulses, the controller generating a simulated machine clock signal based on a running average of a plurality of said actual machine clock periods, the controller using the simulated machine clock signal to count up to said nominal number following firing of said first imager for a given scanline of said image data to determine a target time for firing said second imager for said given scanline.

2. The device of claim 1, wherein a plurality of said scanlines comprise a scanline block, and wherein the controller determines said target time for only a first one of said scanlines said scanline block.

3. The device of claim 2, wherein the controller determines firing times at said second imager for remaining ones of said plurality of scanlines in said scanline block using a preset time increment following said target time.

4. The device of claim 2, wherein for a given one of said scanline blocks the controller determines a first scanline block time delta between an actual firing time of the first imager and an actual firing time of the second imager, wherein for a subsequent one of said scanline blocks the controller determines a second scanline block time delta between an actual firing time of the first imager and said target time for firing said second imager, wherein the controller calculates a correction time comprising the difference between the first scanline block time delta and the second scanline block time delta, and wherein the controller adjusts said target time for firing said second imager based on said correction time.

5. The device of claim 4, wherein the controller adjusts said target time for firing said second imager by a factor of said correction time divided by the number of said scanlines in said scanline block.

6. The device of claim 5, wherein the controller determines firing times for remaining ones of said plurality of scanlines in said scanline block using a preset time increment following said target time adjusted by a factor of said correction time divided by the number of said scanlines in said scanline block.

7. The device of claim 1, wherein the first imager is a raster output scanner and the second imager is a light emitting diode array.

8. The device of claim 1, wherein the colorants are toners.

9. A method of producing multicolor images from image data containing data representing an image of a first color and an image of a second color to be registered relative to the image of the first color onto a substrate by transferring colorants of the first and second colors to the substrate, in an imaging system having a first imager and a second imager, a photoreceptor belt configured to pass the first imager and the second imager, a photoreceptor drive system coupled to the photoreceptor belt and driving the photoreceptor belt in a process path past the first and second imagers in a process direction, an encoder coupled to the photoreceptor drive system, the encoder generating encoder pulses, the second imager being displaced along the process path from said first imager by a displacement corresponding to a nominal number of the encoder pulses, and a controller, the method comprising:

generating an output from the first imager corresponding to the image of the first color at a first exposure station, generating an output from the second imager corresponding to the image of the second color at a second exposure station;

receiving the encoder pulses from the encoder at the controller, determining an actual machine clock period at the controller based on a time between successive ones of said encoder pulses, generating a simulated machine clock signal at the controller based on a running average of a plurality of said actual machine clock periods, determining a target time for firing the second imager following firing of the first imager for a given scanline of said image data at the controller by using the simulated machine clock signal to count up to said nominal number following firing of said first imager for said given scanline of said image data to determine said target time for firing said second imager for said given scanline.

10. The method of claim 9, wherein a plurality of said scanlines comprise a scanline block, and wherein said target time is determined for only a first one of said scanlines said scanline block.

11. The method of claim 10, wherein firing times at said second imager for remaining ones of said plurality of scanlines in said scanline block are determined using a preset time increment following said target time.

12. The method of claim 10, further comprising:

determining for a given one of said scanline blocks a first scanline block time delta between an actual firing time of the first imager and an actual firing time of the second imager, determining for a subsequent one of said scanline blocks a second scanline block time delta between an actual firing time of the first imager and said target time for firing said second imager, calculating a correction time comprising the difference between the first scanline block time delta and the second scanline block time delta, and adjusting said target time for firing said second imager based on said correction time.

13. The method of claim 12, wherein said target time for firing said second imager is adjusted by a factor of said correction time divided by the number of said scanlines in said scanline block.

14. The method of claim 13, further comprising determining firing times for remaining ones of said plurality of scanlines in said scanline block using a preset time increment following said target time adjusted by a factor of said correction time divided by the number of said scanlines in said scanline block.

15. The method of claim 9, wherein the first imager is a raster output scanner and the second imager is a light emitting diode array.

16. The method of claim 9, wherein the colorants are toners.

* * * * *